United States Patent [19]

Rutkowski

[11] Patent Number: 4,807,805

[45] Date of Patent: Feb. 28, 1989

[54] DUAL ENVELOPE SHEET-FED ASSEMBLY

[75] Inventor: Wayne L. Rutkowski, South Wales, N.Y.

[73] Assignee: Avery International Corporation, Pasadena, Calif.

[21] Appl. No.: 5,458

[22] Filed: Jan. 20, 1987

[51] Int. Cl.[4] ..... B65D 27/10; B65D 27/16

[52] U.S. Cl. ..... 229/69; 229/80

[58] Field of Search ..... 229/69, 80

[56] References Cited

U.S. PATENT DOCUMENTS

| | | | |
|---|---|---|---|
| 2,304,523 | 12/1942 | Young | 229/69 |
| 2,610,784 | 9/1952 | Henry | 229/69 |
| 3,265,289 | 8/1966 | Hiersteiner | 229/80 |
| 3,428,237 | 2/1969 | Dowen | 229/69 |
| 3,626,821 | 12/1971 | Gendron | 229/69 |
| 3,900,159 | 8/1975 | Gendron | 229/69 |
| 4,308,988 | 1/1982 | Jiveman et al. | 229/80 |

FOREIGN PATENT DOCUMENTS

| | | | |
|---|---|---|---|
| 921378 | 3/1963 | United Kingdom | 229/69 |

*Primary Examiner*—Stephen P. Garbe

*Attorney, Agent, or Firm*—Poms, Smith, Lande & Rose

[57] ABSTRACT

An envelope assembly has rectangular form and cross-sectional thickness consistency for utilization with a sheet-feed printing apparatus. The assembly includes a first sheet having a centrally located transverse perforated tear line, and a second composite sheet having sections forming pockets, and strips forming sealing flaps toward the central tear line, so that the assembly has substantially the same thickness throughout. Thus, printing apparatus systems that have capabilities only for feed bin, paper tray or paper cassette feeding methods and are incapable of handling single business-size envelopes can be utilized for envelope printing with the present invention.

16 Claims, 2 Drawing Sheets

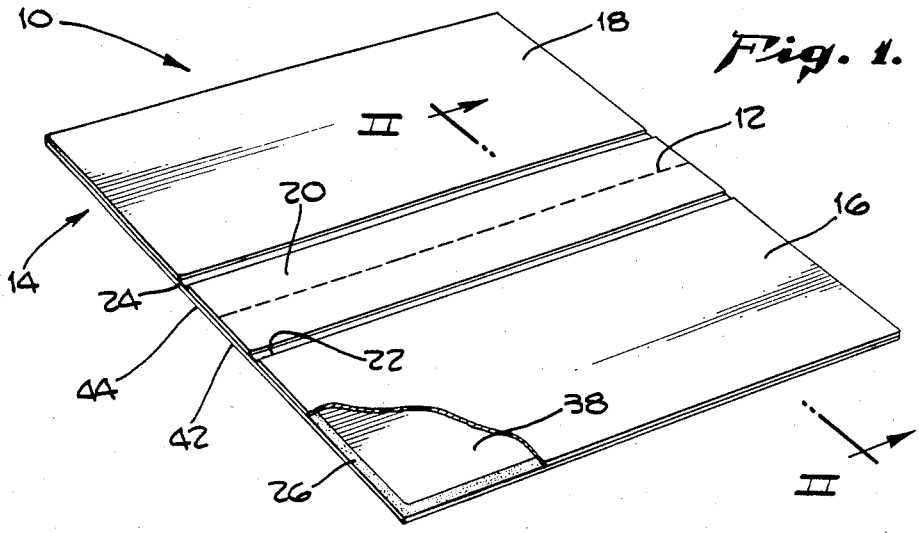
Fig. 1.
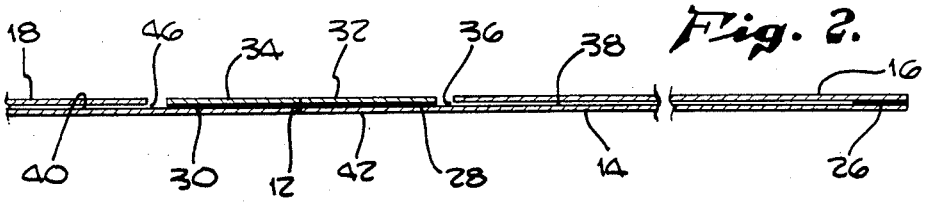
Fig. 2.
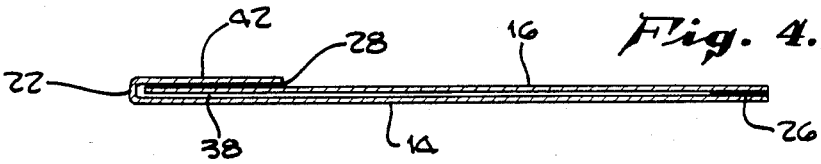
Fig. 4.
Fig. 3.
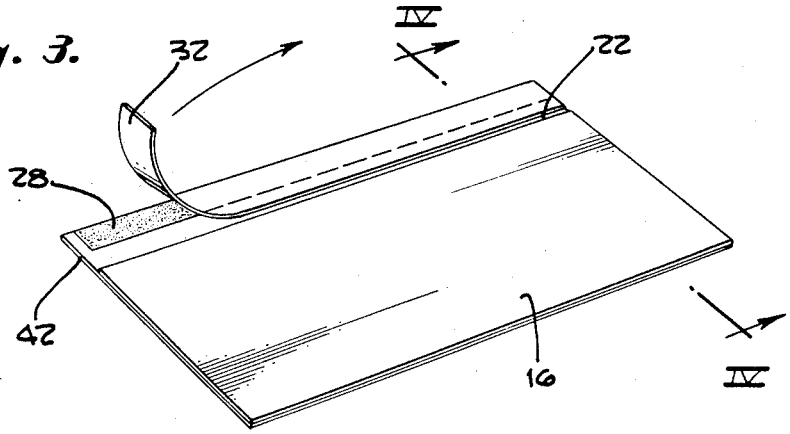

DUAL ENVELOPE SHEET-FED ASSEMBLY

FIELD OF THE INVENTION

This invention relates generally to mailing envelopes and, more specifically, to an envelope assembly for utilization with a sheet-feed printing apparatus.

BACKGROUND OF THE INVENTION

In the field of office and home computing and printing equipment, the advent of personal computing systems, and computer systems equipped with sheet-feed printers, has made the standard typewriter virtually obsolete. However, the problem of addressing envelopes has in some cases led to the retention of typewriters when they would otherwise be eliminated. More specifically, the printer devices associated with computer systems most commonly use either continuous forms or require the loading of multiple sheets of paper into a feed bin. It has previously been proposed to employ a roll of envelope paper which can be separated into single envelope forms by tearing and folding along a number of transverse lines. Such envelope rolls can be utilized with continuous form feed printers but not with sheet-feed apparatus. Sheet-feed devices, e.g., feed bins, paper trays or paper cassettes are capable only of printing on standard 8½ by 11 inch size paper, or modest variations therefrom. Thus, those printing systems utilizing the sheet-feed method are incapable of printing directly upon the standard letter size business envelope. The addressing of envelopes for letters or documents must be done manually on a typewriter which is often used for nothing else. While it has become standard practice to employ prepared addressing labels for application to the envelopes, this process is itself time consuming and inefficient. In addition, the sheet-feed apparatuses require a substantially flat piece of paper in order to efficiently feed the paper through the printing process.

It is, therefore, a principal object of the present invention to provide an envelope assembly which is capable of being utilized with a sheet-feed printing apparatus and which can be fed into the machine from a stacked configuration.

SUMMARY OF THE INVENTION

In accordance with one aspect of the present invention, a dual envelope assembly for utilization with a sheet-feed printing apparatus includes a first paper sheet and a second paper sheet. The first paper sheet is bisected by a transverse perforated tear line, with one envelope being formed on either side of the tear line, and has adjacent first and second transverse fold lines to form the flaps for the envelopes. The second paper sheet is a composite sheet having more than one section. The second sheet is superposed over the first paper sheet, with first and second sections thereof, which are substantially the same size, terminating adjacent to the fold lines. An adhesive border is used to permanently secure the first and second sections of the second paper sheet to the first paper sheet. The adhesive is disposed along the borders of the first paper sheet, forming two separate envelope pockets that open toward the first and second transverse fold lines. The first paper sheet also has first and second adhesive flaps located between the tear line and the first and second transverse fold lines. The envelope assembly may have two addresses applied to the first sheet in a sheet-feeding printer apparatus. After being imprinted by the printer apparatus the envelopes may be subsequently separated at the perforated tear line to form two separately addressed envelopes. The first and second adhesive flap means and closure flaps may then be folded for sealing closure with the pockets.

In accordance with another aspect of this invention, the second composite sheet may further include a silicone-coated release strip, which is removable overlying the adhesive flap means. The silicone-coated release strip and the first and second sections may be of substantially the same cross-sectional thickness in order to most efficiently move through the printer apparatus.

Alternatively, the present invention may be utilized without the silicone-coated release strip in which case the adhesive flap may be overlaid with paper strip coated with a moisture-activated adhesive.

In accordance with a feature of the invention, the two sheets form a dual envelope assembly which is substantially uniform in thickness so that a stack of the envelope assemblies is readily fed through a sheet-feed printer. In this connection, the release strips in one embodiment, and the strips carrying the moisture activated adhesive in the other embodiment provide uniformity of thickness toward the center of the assembly.

Other objects, features and advantages of the invention will become apparent from consideration of the following detailed description and from the accompanying drawings.

BRIEF DESCRIPTION OF THE DRAWINGS

FIG. 1 is an isometric view of a first embodiment of a dual envelope assembly illustrating the principles of the present invention;

FIG. 2 is a cross-sectional view of the envelope assembly of FIG. 1 taken through plane II—II of FIG. 1;

FIG. 3 shows one-half of the dual envelope assembly of FIG. 1, showing partial removal of the silicone coated release strip, prior to sealing the envelope;

FIG. 4 is a cross-sectional view taken generally along lines IV—IV of the envelope assembly as shown in FIG. 3, but following sealing of the envelope;

DETAILED DESCRIPTION

Figure 5:
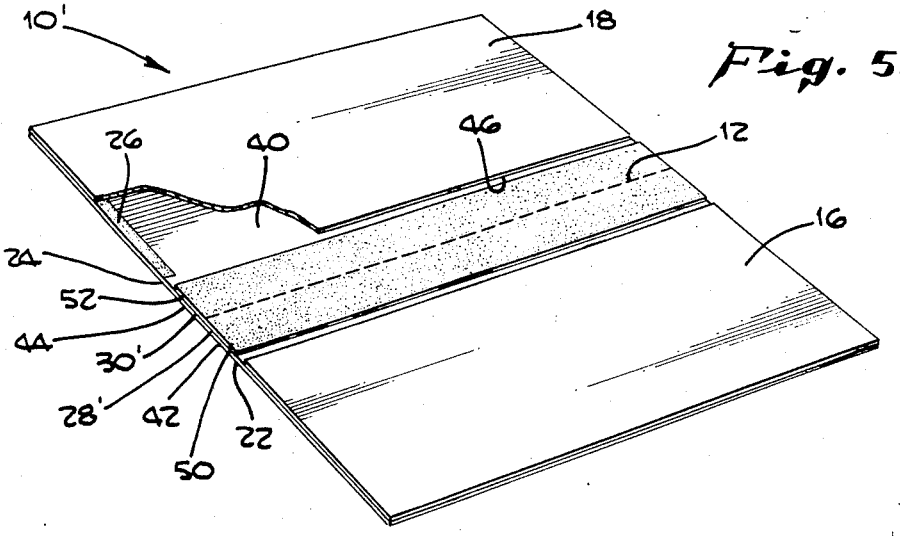
FIG. 5 is an isometric view of an alternative embodiment of the envelope assembly.

Referring more particularly to the drawings, FIG. 1 is an isometric view showing a preferred embodiment of the dual envelope assembly 10. Dual envelope assembly 10 is divided into two envelope sections by transverse perforated tear line 12. A first paper sheet 14 (best shown in FIG. 2) includes perforated tear line 12 and transverse fold lines 22 and 24. First paper sheet 14 may be rectangular in form, for example 9½ inches by 11 inches, so as to fit in a common paper tray or similar sheet-feed device.

A second composite paper sheet is made up of a first composite section 16, a second composite section 18, and a third composite section 20. The first and second composite sections, 16 and 18 respectively, are superposed over opposite ends of first sheet 14 and attached thereto by adhesive 26.

The adhesive border 26 is an adhesive of the type normally known as a permanent adhesive. The adhesive border 26 is applied in a U-shaped configuration so as to extend around the border of first paper sheet 14 where first composite section 16 and second composite section 18 are superposed thereover. The result is that first and second pocket chambers 38 and 40 are formed; the borders of which are formed by a permanent bond between respective composite sections 16 and 18 and underlying first paper sheet 14. In accordance with standards and procedures as established by the Pressure Sensitive Tape Council, the designation of a "permanent adhesive" refers to an adhesive having a peel force in the order of 3 pounds or more. The force specified is that required to peel (peel force) a one-inch sample strip at right angles from a stainless steel surface to which it has been adhered.

Referring now to FIG. 2, FIG. 2 is a partial cross-sectional view taken along lines II—II of the envelope assembly of FIG. 1. Pocket chambers 38 and 40 are formed by the superposition of first and second composite sections 16 and 18 respectively upon first paper sheet 14. First pocket opening 36 of pocket chamber 38 allows for the subsequent insertion of materials into one of the envelopes of the dual envelope assembly 10. Similarly, second pocket opening 48 of pocket chamber 40 allows for insertion of materials into the envelope constituting the other half of envelope assembly 10. The first closure flap portion 42 of first paper sheet 14 is the portion between first transverse fold line 22 and perforated tear line 12; and the second closure flap portion 44 of the first paper sheet 14 is the portion between second transverse fold line 24 and perforated tear line 12. Closure flaps 42 and 44 are coated by thin stripes of permanent adhesive 28 and 30, respectively.

The second composite paper sheet includes a third composite section 20 which is made up of a first removable strip 32 and a second removable strip 34. The first and second removal strips 32 and 34 are separated by perforated tear line 12 and may be made of, for example, paper coated with a silicone release layer, to allow easy removal of the strips from the adhesive stripes 28 and 30 respectively, as shown in FIG. 3.

Turning now to FIG. 3, FIG. 3 shows an envelope formed from one-half of envelope assembly 10 after separation along perforated tear line 12. The removable strip 32 may be removed from the adhesive stripe 28 in order to provide a sealing surface for closure of pocket chamber 38 (best shown in FIG. 4). The closure flap 42 coated by the permanent adhesive stripe 28, may then be folded along transverse fold line 22 in order to seal envelope pocket 38. The removable strip 32 may then be discarded. The provision of removable strips 32 and 34 affords an even surface (best shown in FIG. 2) enabling efficient feeding into a printer sheet-feed apparatus. Further, utilization of removable strips 32 and 34 enable effective closure of the envelope without utilization of moisture.

FIG. 4 is a cross-sectional view of an envelope made up of one-half of envelope assembly 10, in a closed or sealed condition. Closure flaps 42 and 44, being coated with stripes of permanent adhesive 28 and 30, form a permanent closure of pocket openings 36 and 46 when folded at transverse fold lines 22 and 24 respectively. Pocket chambers 38 and 40 are then bonded by a permanent adhesive on all four sides, thereby precluding the contents placed within pocket chambers 38 and 40 from accidentally falling out.

It should be noted here that envelope assembly 10 is not separated along perforated tear line 12 until after the address or other image is reproduced thereon. The envelope assembly can be directly imaged with all pertinent information, e.g., mailing address, return address, etc., through a software program in the case of a printer or from an original document in the case of a copier. Envelope assembly 10 is placed in a sheet-feed apparatus so as the printing device imprints upon either or both halves of first paper sheet 14. It is apparent, then, that the dimensions of the envelope assembly may vary slightly, limited by printer feed sizing restrictions. As subsequent closure of closure flaps 42 and 44 make apparent, the printer image is made on the exposed side of first paper sheet 14 that is opposite the second composite paper sheet.

An alternative embodiment 10' of envelope assembly 10 is shown in FIG. 5. First closure flap 42 and second closure flap 44 are coated with stripes of permanent adhesive 28' and 30' to permanently secure strips of paper 50 and 52 over the flaps 42 and 44. Strips of paper 50 and 52 make up third composite section 20 and are coated with moisture-activated adhesives. Alternative embodiment 10' replaces the first removable strip 32 and second removable strip 34 of envelope assembly 10, with strips of paper 50 and 52. The cross-sectional thickness of alternative embodiment 10' is constant (best shown in FIG. 7), as was that of envelope assembly 10. A constant cross-sectional thickness allows for easy stacking and efficient feeding of the envelope assemblies into paper trays, cassettes, etc. The imprinting of alternative embodiment 10' is performed similarly as was done with envelope assembly 10.

Figure 6:
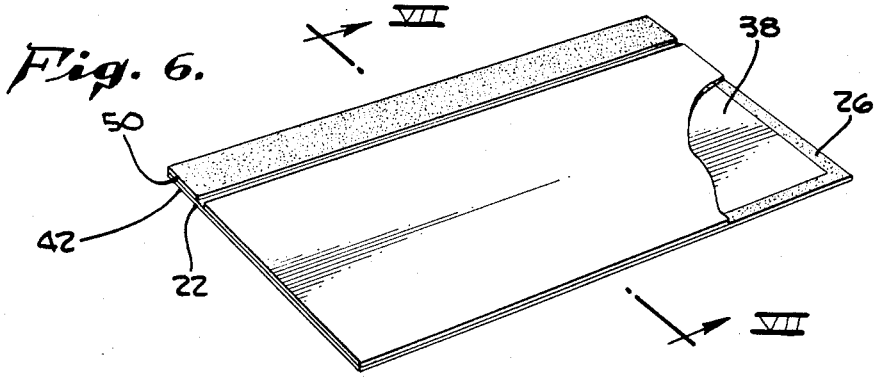
FIG. 6 is an isometric view of the envelope assembly of FIG. 5 after separation of the two envelopes.

Alternative embodiment 10' may then be separated along perforated transverse tear line 12 as shown in FIG. 6. In view of the fact that many mail postage meters have envelope sealing capabilities, the utilization of a moisture-activated adhesive coating paper strips 50 and 52 allows the envelope of such alternative embodiment 10' to be posted through such machines and automatically seal closure flaps 42 and 44.

Figure 7:
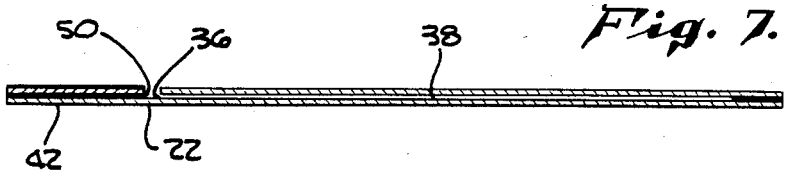
FIG. 7 is a cross-sectional view of the envelope assembly taken through plane VII—VII of FIG. 6.

Referring to FIG. 7, FIG. 7 is a cross-sectional view of alternative embodiment 10' after separation along perforated tear line 12. Moisture-activated strips 50 and 52 are so applied as to be of substantially the same cross-sectional thickness as first composite section 16 and second composite section 18 when same are adhesively applied by adhesive border 26 to first paper sheet 14. Again, the consistency and similarity of cross-sectional thicknesses between pocket chambers 38 and 40 and closure flaps 42 and 44 allow for ease and efficiency of feeding through a single sheet-feed printing apparatus.

It should be noted that permanent adhesive stripes 28' and 30' and strips of paper 50 and 52 could be replaced with a single strip of moisture-activated adhesive subject only to the cross-sectional thickness requirements of sheet-fed apparatus.

Figure 8:
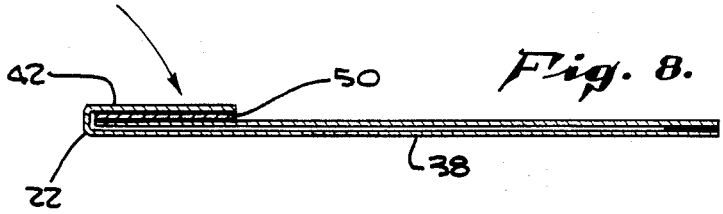
FIG. 8 is a cross-sectional view of the envelope assembly taken through plane VII—VII of FIG. 6 showing an envelope in a sealed configuration.

Sealing of pocket chambers 38 and 40 by closure flaps 42 and 44 is depicted in FIG. 8, a cross-sectional view of alternative embodiment 10' taken through plane VII—VII of FIG. 6. Closure flaps 42 and 44 are folded along transverse fold lines 22 and 24, respectively, thereby effectively sealing pocket openings 36 and 46 and preventing the contents of pocket chamber 38 from spilling out.

The overall dimensions of the dual envelope assembly are limited only by the capabilities of the feed bins or paper trays of the printers or copiers. In accordance with most common paper cassette tray copiers, the dual envelope assembly may be from about six or eight inches up to 14 inches in length and up to nine inches in the transverse direction. However, it is contemplated that variations in these dimensions suitable for use in available sheet feeding printers, may be used.

In the foregoing description of the present invention, a preferred embodiment and alternative embodiments of the invention have been disclosed. It is to be understood that other design variations are within the scope of the present invention. Thus, by way of example and not of limitation, the envelope assembly construction can be produced using a variety of methods and adhesives. In addition, utilization of legal size or 14 inch paper may enable 3 envelopes to be manufactured on each assembly sheet. Further, the dual envelope assembly may be manufactured with one of the envelopes rotated 180 degrees, and the closure flap portion of one envelope attached to the bottom of the pocket chamber of the other. Accordingly, the invention is not limited to the particular arrangement which has been illustrated and described in detail herein above.

What is claimed is:

1. A dual envelope assembly for utilization with a sheet-feed printing apparatus comprising:

a first paper sheet bisected by a transverse perforated tear line, and having first and second transverse fold lines adjacent to, but spaced away from, said tear line;

a composite paper sheet layer, including second and third separate, individual paper sheets, said second and third sheets being of substantially the same size, and superposed over opposite ends of said first sheet and each terminating adjacent said fold lines;

means for permanently securing said second and third sheets to said first paper sheet, to form two pockets which open toward said first and second transverse fold lines, said securing means including an adhesive border disposed along the borders of said first sheet, and three borders of said second and third sheets;

each of said two pockets having a length which is greater than the depth thereof, and being open along one of the longer sides thereof, and said two pockets having their longer sides parallel to one another and with the two ends of the shorter sides being aligned with one another;

means on said first paper sheet, interposed between said first and second transverse fold lines, for sealing said pockets, said sealing means including first and second adhesive coated flaps, said first and second adhesive coated flaps being separated by said perforated tear line; and said assembly having a simple, flat rectangular configuration, free of protrusions, webs, folds, or openings which could interfere with sheet feeding of a plurality of said assemblies through a laser printer or the like;

whereby said assembly may have two addresses applied to said first sheet in a sheet-feeding printer apparatus, and may be subsequently separated at said perforated tear line to form two addressed envelopes.

2. A dual envelope assembly as defined in claim 1 wherein said flaps are coated with a pressure sensitive adhesive and wherein said composite sheet layer further comprises:

at least one silicon-coated release strip removably overlying said adhesive coated flaps.

3. A dual envelope assembly as defined in claim 2 wherein said second and third sheets and said silicon-coated release strip are of substantially the same cross-sectional thickness.

4. A dual envelope assembly as defined in claim 1 wherein said adhesive coated flaps include a moisture-activated adhesive.

5. A dual envelope assembly as defined in claim 1 wherein the release strip further comprises a first and second portion, said first and second portions each removable overlying the first and second adhesive flap means, respectively.

6. A dual envelope assembly as defined in claim 1 herein said composite sheet layer further comprises:

a strip carrying moisture activated adhesive overlying and permanently secured to each of said adhesive coated flaps.

7. A dual envelope assembly as defined in claim 1 wherein said assembly is rectangular in form substantially in the size of normal sheets of paper capable of being sheet fed through a laser printer of the like, and said assembly has a substantially uniform thickness.

8. A dual envelope assembly as defined in claim 1 wherein said assembly is between 6 and 14 inches in length and between 8½ and 9½ inches in width.

9. A dual envelope assembly for utilization with a sheet-feed printing apparatus comprising:

a first paper sheet bisected by a transverse perforated tear line, and having first and second transverse fold lines adjacent to, but spaced away from, said tear line;

a composite paper sheet layer, including second and third separate, individual paper sheets, said second and third sheets being of substantially the same size, and superposed over opposite ends of said first sheets and each terminating adjacent said fold lines;

means for permanently securing said second and third sheets to said first paper sheet, to form two pocket which open toward said first and second transverse fold lines, said securing means including an adhesive border disposed along the borders of said first sheet, and three borders of said second and third sheets;

each of said two pockets having a length which is greater than the depth thereof, and being open along one of the longer sides thereof, and said two pockets having their longer sides parallel to one another and with the two ends of the shorter sides being aligned with one another;

means on said first paper sheet, interposed between said first and second transverse fold lines, for sealing said pockets, said sealing means including first and second adhesive coated flaps, said first and second adhesive coated flaps being separated by said perforated tear line; and said assembly having a simple, flat rectangular configuration, free of protrusions, webs, folds, or openings which could interfere with sheet feeding of a plurality of said assemblies through a laser printer or the like;

whereby said assembly may have two addresses applied to said first sheet in a sheet-feeding printer apparatus, and may be subsequently separated at said perforated tear line to form two addressed envelopes.

10. A multiple envelope assembly for utilization with a sheet feed printing apparatus comprising:

a first paper sheet having one or more transverse perforated tear lines and a plurality of transverse fold lines;

a second composite paper sheet having a plurality of sections superposed over said first paper sheet and terminating adjacent said fold lines;

means including an adhesive border for permanently securing said first paper sheet and said second composite paper sheet together to form pockets between said second sheet sections and said first sheet; said adhesive border being disposed along the borders of said second paper sheet sections, to form the plurality of pockets opening at said transverse fold lines;

each of said plurality of pockets having a length which is greater than the depth thereof, and being open along one of the longer sides thereof, and said pockets having their longer sides parallel to one another and with the two ends of the shorter sides of each pocket being aligned with the corresponding shorter sides of other of the plurality of pockets;

means including a plurality of transverse closure flaps extending transversely across said sheet on the other side of said transverse fold lines from each said pocket for sealing said pockets; and said assembly including said first and second sheets and said flap means having a substantially uniform double sheet thickness over substantially the entire area of said assembly; and said assembly having a simple, flat rectangular configuration, free of protrusions, webs, folds, or openings which could interfere with sheet feeding of a plurality of said assemblies through a laser printer or the like;

whereby said assembly may have addresses applied to said first paper sheet in a sheet-feeding printer apparatus, and may be subsequently separated at the perforations to form a plurality of addressed envelopes.

11. An envelope assembly for utilization with a sheet feed printing apparatus comprising:

a first paper sheet having at least one transverse perforated tear lines and a plurality of transverse fold lines;

a second composite paper sheet layer having a plurality of separate, individual sections of sheet paper supposed over said first paper sheet and terminating adjacent said fold lines;

means for permanently securing said first paper sheet and said second composite paper sheet layer together to form pockets between the second layer sections and said first sheet; said securing means including adhesive disposed along three sides of the borders of the second paper sheet sections, to form the plurality of pockets opening at said transverse fold lines;

each of said plurality of pockets having a length which is greater than the depth thereof, and being open along one of the longer sides thereof, and said pockets having their longer sides parallel to one another and with the two ends of the shorter sides of each pocket being aligned with the corresponding shorter sides of other of the plurality of pockets;

means for sealing said pockets, said sealing means including a plurality of transverse closure flaps extending transversely across said sheet on the other side of said transverse fold lines from each said pocket;

said assembly including said first sheet, said second composite sheet layer and said closure flaps having a substantially uniform double sheet thickness over substantially the entire area of said assembly; and said assembly having a simple rectangular configuration between 8½ and 9½ inches wide and between 6 and 14 inches in length, each said assembly being formed as an individual, double thickness, flat rectangular assembly without protrusions, folds, openings, or connecting webs to interfere with sheet feeding of a plurality of said assemblies through a laser printer or the like;

whereby said assembly may have addresses applied to said first paper sheet in a sheet-feeding printer apparatus, and may be subsequently separated at the perforations to form a plurality of addressed envelopes.

12. An envelope assembly as defined in claim 11 wherein each closure flap includes a stripe of permanent adhesive extending for at least most of the length thereof, and a removable strip coated with a release material overlying each said stripe of adhesive.

13. An envelope assembly as defined in claim 11 wherein each said closure flap includes a moisture activated adhesive layer.

14. An envelope assembly as defined in claim 11 wherein said assembly includes a single central perforated tear line, and only two envelopes having their open pockets facing the central tear line.

15. An envelope assembly for utilization with a sheet feed printing apparatus comprising:

a first paper sheet having one or more transverse perforated tear lines and a plurality of transverse fold lines;

a second composite paper sheet layer having a plurality of separate, individual sections of sheet paper superposed over said first paper sheet and terminating adjacent said fold lines;

means for permanently securing said first paper sheet and said second composite paper sheet layer together to form pockets between the second layer sections and said first sheet; said securing means including adhesive disposed along three sides of the borders of the second paper sheet sections, to form the plurality of pockets opening at said transverse fold lines;

each of said plurality of pockets having a length which is greater than the depth thereof, and being open along one of the longer sides thereof, and said pockets having their longer sides parallel to one another and with the two ends of the shorter sides of each of said pockets being aligned with one another;

means for sealing said pockets, said sealing means including a plurality of transverse closure flaps extending transversely across said sheet on the other side of said transverse fold lines from each said pocket; and said assembly including said first sheet, said second composite sheet layer and said closure flaps having a simple substantially rectangular configuration free of protrusions, folds, openings, or webs to interfere with sheet feeding;

whereby said assembly may have addresses applied to said first paper sheet in a sheet-feeding printer apparatus, and may be subsequently separated at the perforations to form a plurality of addressed envelopes.

16. A dual envelope assembly as defined in claim 15 wherein said assembly is between 6 and 14 inches in length and between $8\frac{1}{2}$ and $9\frac{1}{2}$ inches in width.

* * * * *